US005485873A

United States Patent [19]

Crammond

[11] Patent Number: 5,485,873

[45] Date of Patent: Jan. 23, 1996

[54] KNIFE CLAMPING SYSTEM

[75] Inventor: Patrick J. Crammond, Coquitlam, Canada

[73] Assignee: CAE Machinery Ltd., Canada

[21] Appl. No.: 287,662

[22] Filed: Aug. 9, 1994

[51] Int. Cl.[6] ..... B27C 1/00

[52] U.S. Cl. ..... 144/162 R; 144/172; 144/174; 144/176; 144/373; 241/92; 241/278.2; 241/301; 407/41

[58] Field of Search ..... 407/37, 41, 50, 407/49, 87, 91, 94, 95, 108–110; 241/92, 93, 278.1, 278.2, 301; 144/162 R, 172, 174, 176, 230, 373

[56] References Cited

U.S. PATENT DOCUMENTS

| | | | |
|---|---|---|---|
| 2,805,468 | 9/1957 | Williams | 407/41 |
| 4,298,044 | 11/1981 | Hansel et al. . | |
| 4,685,497 | 8/1987 | Mierau et al. . | |
| 4,887,772 | 12/1989 | Robinson et al. | 144/176 |
| 4,972,888 | 11/1990 | Dean | 144/174 |
| 4,977,939 | 12/1990 | Depuy et al. . | |
| 4,997,018 | 3/1991 | Carpenter et al. . | |
| 5,129,437 | 7/1992 | Nettles et al. | 144/176 |
| 5,271,442 | 12/1993 | Carpenter et al. | 144/162 R |
| 5,287,901 | 2/1994 | Matthews | 144/176 |

*Primary Examiner*—W. Donald Bray
*Attorney, Agent, or Firm*—Poms, Smith, Lande & Rose

[57] ABSTRACT

An improved knife clamping system for use in an apparatus for processing wood, such as a flaker, chipper or waferizer, that employs a rotary disc or ring, cutting knives, holding locations mounted on the disc or ring to receive the cutting knives, clamping members to engage and hold the cutting knives in position and fasteners to mount the clamping members to the holding locations. The improvement comprises providing a surface having an undulating profile to engage against the cutting knives. The undulating surface can be formed on the clamping member, at the holding location or at both locations. The surface is shaped to deform to engage the cutting knives with a uniform clamping load upon securing of the fasteners to a pre-selected torque. The foregoing arrangement requires fewer fasteners while still maintaining an adequate clamping force on the cutting knives. This makes parts less expensive and reduces the time to change the knives as there are fewer parts to loosen and tighten.

15 Claims, 4 Drawing Sheets

KNIFE CLAMPING SYSTEM

FIELD OF THE INVENTION

This invention relates to apparatus for processing wood and to a knife clamping system useful in apparatus for processing wood.

BACKGROUND OF THE INVENTION

Apparatus for processing wood are well known. Such apparatus is used to convert wood, in the form of raw logs or boards, into wafers, chips or strands for use in various types of composite boards, paper or the like.

Wood processing apparatus generally employ a large rotating disc or ring mounted on a driven shaft. A series of cutting knives are mounted to the disc face or about the inner or outer periphery of the ring, often by bolts. The rotating disc or ring is positioned adjacent to a chamber for holding logs. The disc or ring is also mounted to a carriage that allows the rotating disc or ring to be slowly advanced through the logs in the chamber. The rotating knives convert the wood into wafers, or strands that are collected and conveyed away below the carriage. The carriage then retracts allowing a new batch of logs to be delivered to the chamber for processing.

In wood processing apparatus of this type, the knives need to be regularly maintained. Even with scheduled maintenance, knives can be damaged during normal use and it is important to be able to replace the knives as quickly as possible to minimize down time and lost production.

At present, most knives are mounted to the disc or ring by a carrier member and a clamp member. Each knife comprises an elongated blade member having a cutting edge. The carrier member is mounted to the disc or ring via a carrier support. The carrier member provides a surface to receive an elongate knife blade. The knife blade is sandwiched between the carrier member and the clamp member and the clamp member is held against the knife blade by a series of locating bolts that extend through the clamping member and into threaded inserts located within a recess in the carrier member. To maintain a relatively consistent clamping force, the clamping member is formed as thick and stiff as possible so that the number of locating bolts can be kept to a minimum. At the same time, due to the limited space in many wood processing apparatus, the thickness of the clamping member is limited and clamping bolts must be close together to ensure reliable positioning of the knife blade on the carrier by the clamping member. The more locating bolts that are necessary to locate the clamping member, the greater the time to replace worn or damaged knife blades.

SUMMARY OF THE INVENTION

The present invention seeks to provide a knife clamping arrangement for wood processing equipment that reduces the number of locating bolts for securing a clamping member while still maintaining a consistent clamping force on the knife blade.

The present invention provides an improved knife clamping system for use in an apparatus for processing wood, such as a flaker, chipper or waferizer, that employs a rotary disc or ring, cutting knives, holding locations mounted on the disc or ring to receive the cutting knives, clamping members to engage and hold the cutting knives in position and fasteners to mount the clamping members to the holding locations. The improvement comprises providing at least one surface having an undulating profile to engage against the cutting knives. The at least one surface is shaped to deform to engage the cutting knives with a substantially uniform clamping load upon securing of the fasteners to a pre-selected torque.

The at least one undulating surface can be formed on the clamping member, on the knife carrier member or at both locations.

When a locating bolt is torqued to a specified value using the new design of the present invention, the surface deforms to provide a more consistent load per lineal inch across the cutting knives to secure the knives in place.

The apparatus of the present invention provides an arrangement that requires fewer locating bolts while providing the same clamping force which makes parts less expensive and reduces the time to change knives as there are fewer parts to loosen and tighten. Down-time for maintenance and repairs is reduced and production time is increased.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

The improved knife clamping arrangement of the present invention is suitable for use with any wood processing equipment that employs a knife that is held in place by a clamping member. As such the knife clamping arrangement of the present invention can be used on chipping, flaking or waferizing equipment that employs a rotary disc or ring or similar rotary member. The embodiments of the present invention described and illustrated in the present application relate specifically to a knife clamping arrangement for use in a ring flaker as described in applicant's corresponding U.S. patent application Ser. No. 08/123,425, filed Sep. 17, 1993, and a knife clamping arrangement for use in a disc waferizer. It should be noted that the present application is not limited solely to the specific arrangement illustrated and described.

Figure 1:
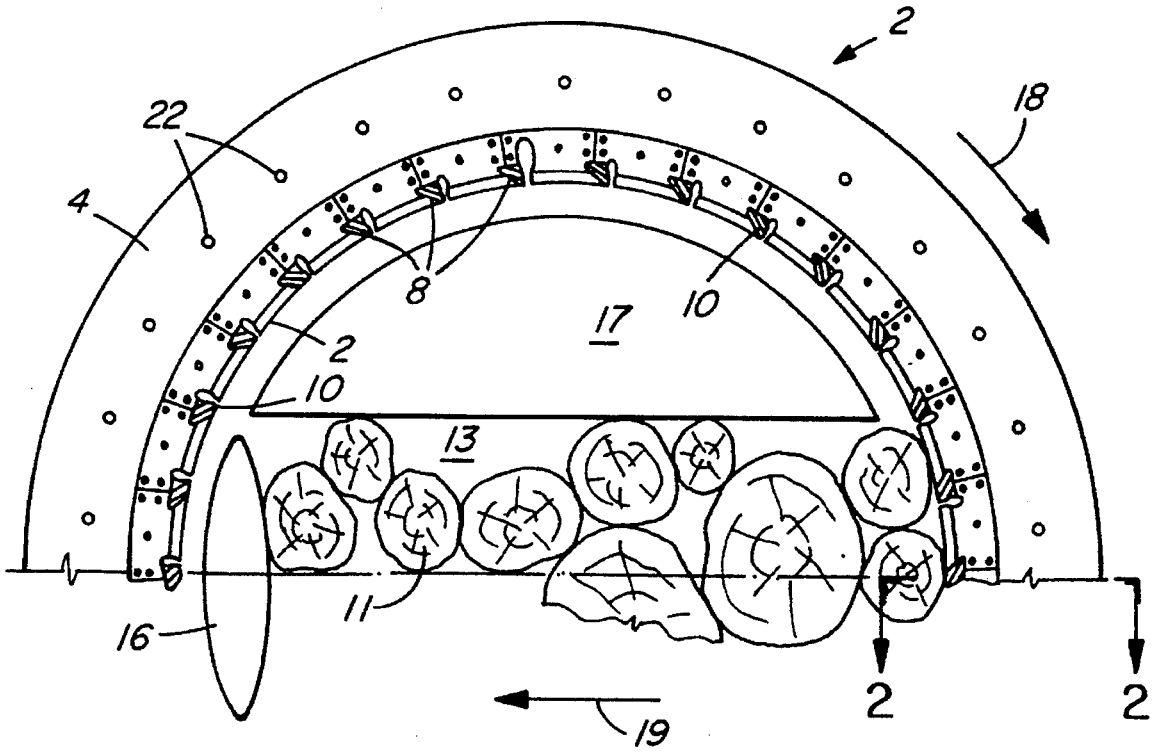
FIG. 1 is a side view of part of a blade ring from a ring flaker.

Referring to FIG. 1, there is shown a partial view of a knife blade ring assembly 2 of a ring flaker. The knife blade ring assembly acts as a rotatable support surface. The assembly is formed from a pair of spaced, parallel rings 4 and 6 having a plurality of spaced, knife holding locations 8 mounted therebetween at regular intervals about the inner periphery 12 of the rings. Each knife holding location 8 secures cutting means in the form of an elongate knife 10 positioned at inner periphery 12 of the blade ring assembly 2. The enclosed interior 13 of blade ring assembly 2 defines a chamber to hold logs 11 for processing. A stationary backstop 16, an upper segment 17 and a corresponding lower segment (not shown) define a chamber that holds logs 11 to be processed. Blade ring assembly 2 is rotated in the direction of arrow 18 and advanced in the direction of arrow 19 through the logs to cut the logs into flakes by the action of knives 10. Backstop 16 remains stationary with respect to the ring assembly and the upper and lower segments move with the ring assembly to contain and hold the logs while being processed.

Figure 2:
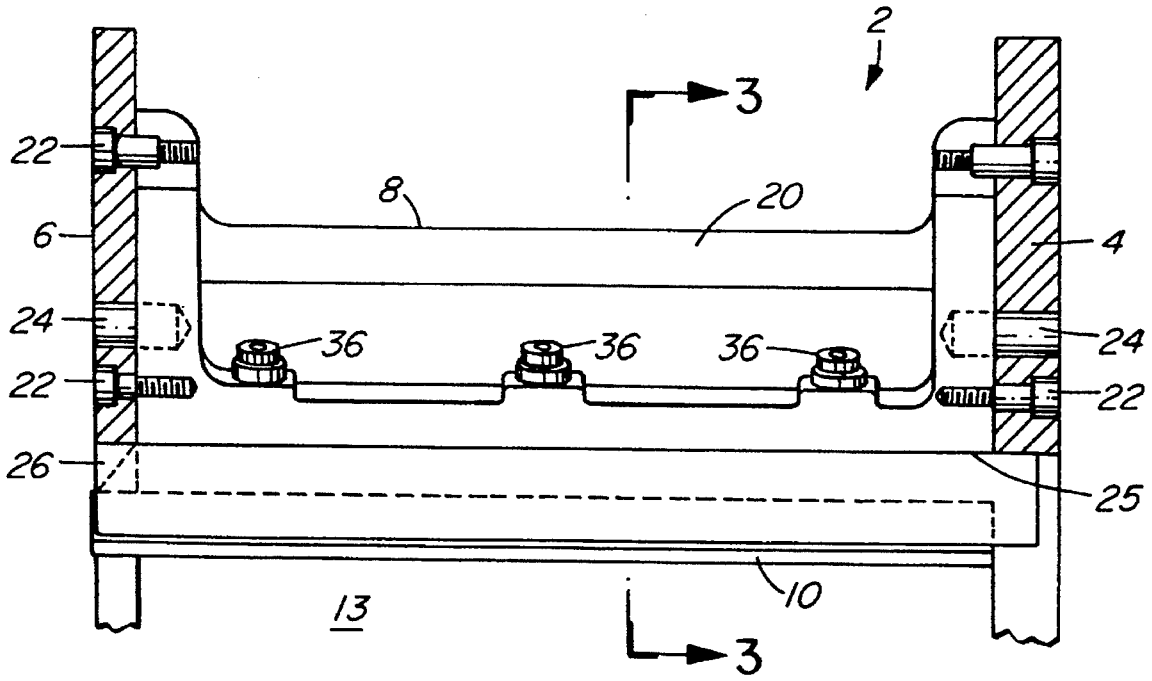
FIG. 2 is a section view through the blade ring of FIG. 1 taken along line 2—2 showing the knife clamping arrangement of the present invention.

FIG. 2 is a detail view of a knife holding location 8 taken along line 2—2 of FIG. 1. Each knife holding location 8 comprises a knife carrier support 20 mounted between spaced, parallel annular rings 4 and 6 by a series of threaded fasteners 22 and aligning pins 24.

Figure 3:
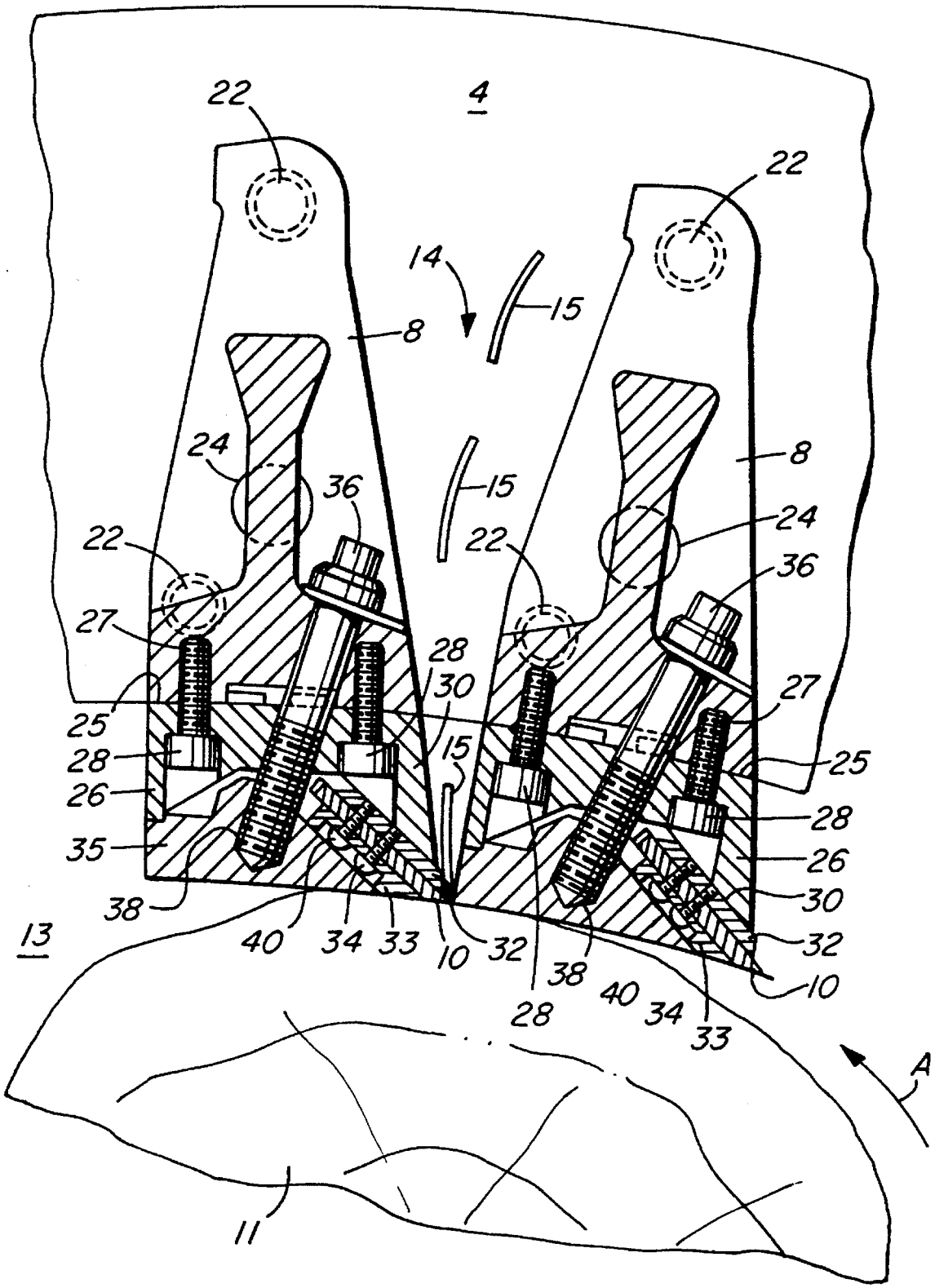
FIG. 3 is a partial section view through the blade ring of FIGS. 1 and 2 taken along line 3—3 of FIG. 2 showing a pair of knife blades and supporting structure.

FIG. 3 is a section view taken along line 3—3 of FIG. 2 showing details of a pair of adjacent knife holding locations 8. In the particular arrangement illustrated, each knife carrier support 20 has a surface 25 that faces the interior 13 of the blade ring to receive a knife carrier 26. Surface 25 is provided with threaded recesses 27 and knife carrier 26 is provided with passages that accommodate fasteners 28 in order to secure carrier 26 to the knife carrier support 20.

The illustrated knife carrier 26 is formed with an angled surface 30 that supports a knife 10. Each knife 10 comprises an elongate cutting blade formed with a cutting surface extending along at least one longitudinal edge. As is conventional, knife 10 is generally mounted between an associated counter knife 32 and scoring knife holder 33 to create a knife pack that is held together by screws 34.

The knife 10 cuts flakes 15 from logs 11 and the flakes exit from interior 13 through passages 14 between adjacent knife holding locations 8 for collection.

The knife pack is held in place against angled surface 30 by clamping means in the form of clamping member 35. In the illustrated embodiment, clamping member 35 is positioned at the inside of the blade ring on carrier 26. This arrangement permits the clamping member to be accessed from the interior of the blade ring for removal and maintenance. Threaded fasteners 36 extend inwardly from the outside of the knife blade ring through aligned passages in knife carrier support 20 and knife carrier 26 to engage clamping member 35 in threaded recesses 38. Alternatively, threaded inserts (not shown) can be provided in recesses 38 to accept the end of fastener 36. In the event that the threads are damaged, it would simply be necessary to change the insert.

Effectively, knife 10 is clamped between surface 40 of clamping member 35 and surface 30 of carrier 26 when fasteners 36 are tightened. One or both of surfaces 30 and 40 are formed with an undulating profile that contacts the knife pack.

Figure 4:
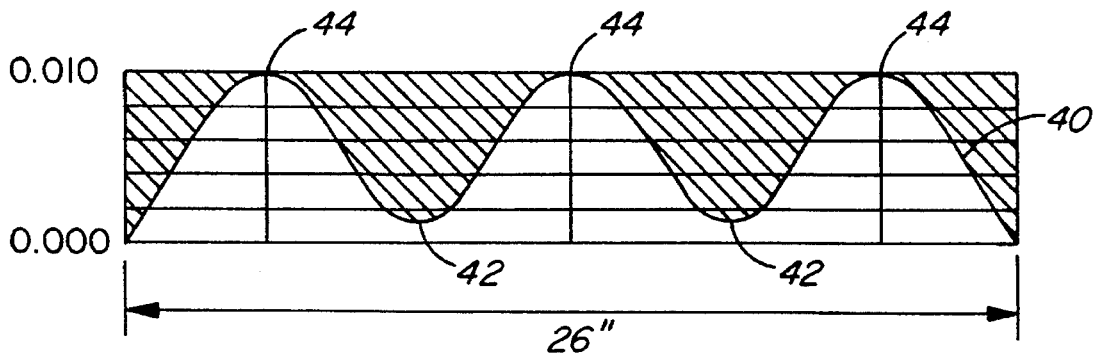
FIG. 4 is a view of a wave profile formed on the surface of the clamping member that engages the knife blade in which the vertical scale is greatly exaggerated.

In a preferred embodiment, surface 40 of clamping member 35 is formed with an undulating profile. FIG. 4 shows a plan view of surface 40 in which the vertical scale is greatly exaggerated as indicated by the different axis scales. Surface 40 is formed by cutting a series of gentle valleys 44 into the clamping surface to define a series of peaks 42. The distance from one end of the clamping surface to the next is in the order of 26 inches while peaks 42 and valleys 44 extend across a distance of only approximately 0.010 inches. FIG. 4 illustrates the dimensions of a particular example of an undulating surface that has been developed by applicant specifically for a particular type of ring flaker. Other surface profiles will be necessary for other types of equipment with different clamping members. The shape of the surface can be developed by finite element analysis using a computer.

Figure 5:
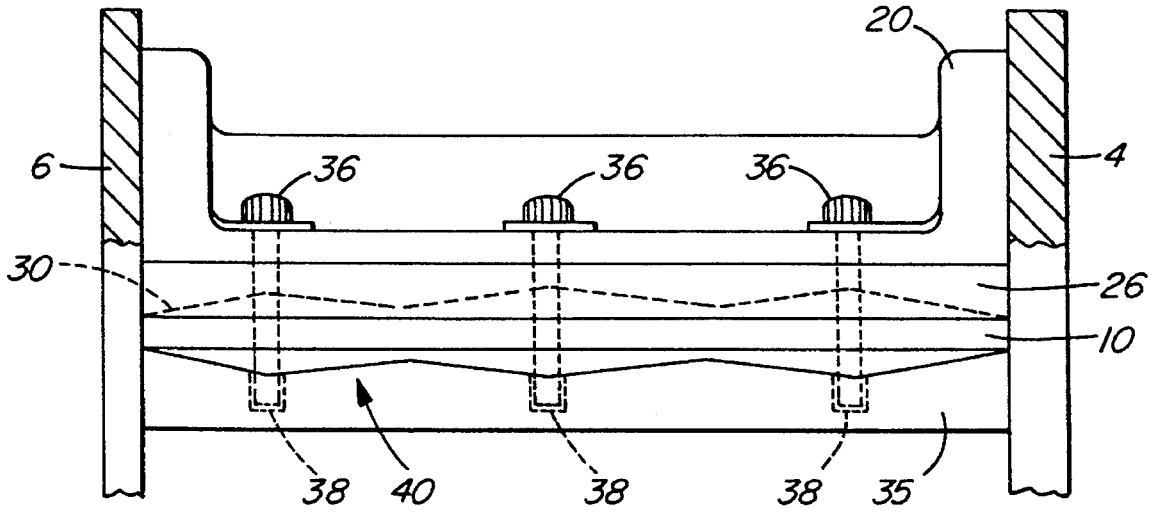
FIG. 5 is a detail view taken along arrow A of FIG. 3 showing engagement of the clamping member and the knife carrier on opposite sides of the knife package, the wave profiles of the clamping member and the knife carrier being greatly exaggerated and the wave profile of the knife carrier being shown by dashed lines.

FIG. 5 is a view taken on arrow A of FIG. 3 looking directly at the knife 10 and shows, by greatly exaggerating the undulations in the clamping surfaces, various embodiments of the knife clamping arrangement of the present invention. In the preferred embodiment, clamping member 35 is formed with undulating surface 40. Knife 10 is held in place by a clamping member 35 that is itself secured by a plurality of fasteners 36. Each fastener 36 is received in a correspondingly threaded recess 38 that is formed in the clamping member in the region of a valley 44 of the undulating surface 40. The protruding end of fastener 36 extends from carrier 26 behind knife 10 across to the base of a valley 44 in surface 40 to be received in a recess 38 of the clamping member. This preferred arrangement is designed such that when fasteners 36 are tightened to a pre-determined torque, surface 40 is deformed to engage the knife pack 10 with a substantially uniform clamping load.

Alternatively, in another embodiment, surface 40 is level and surface 30 of carrier 26 is formed with an undulating profile as shown by the dashed line in FIG. 5. Fasteners 36 are aligned with the valleys of surface 30 and when fasteners 36 are tightened, surface 30 will exert a consistent clamping load across the knife pack.

In a still further embodiment, both surface 30 of carrier 26 and surface 40 of clamping member 35 are formed with substantially similar undulating profiles in which the surfaces are aligned peak to peak and valley to valley. Once again, fasteners 36 are aligned with the valleys of the surfaces. In such an arrangement, the height of the peaks and valleys on the two undulating surfaces would be reduced in comparison with the height of a single undulating surface.

By virtue of the undulating surfaces of the present invention that deform to give a more consistent clamping load across the knife pack than with conventional clamping designs, the clamping arrangement of the present invention can reliably clamp the knife pack to the carrier using fewer fasteners than in conventional clamping designs while providing the same clamping force. This provides the additional advantage that fewer fasteners reduces the time to change knives as there are fewer parts to loosen and tighten. Down-time for maintenance and repairs is reduced and production time is increased.

Figure 6:
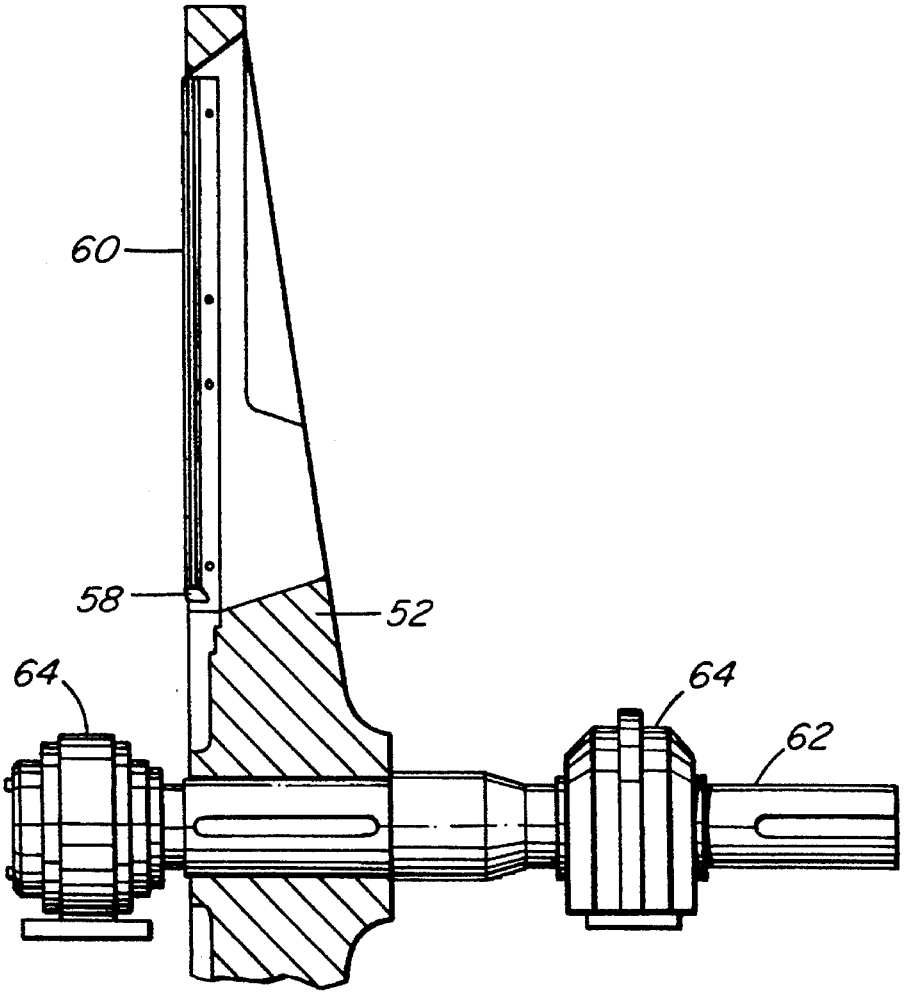
FIG. 6 is a section view through a waferizing disc having the improved clamping system of the present invention.
Figure 7:
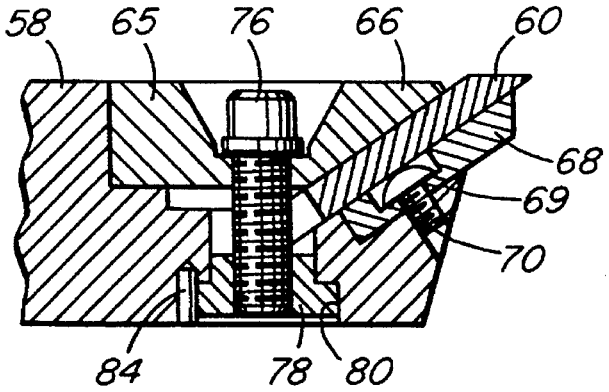
FIG. 7 is a detail view of the clamping arrangement of the disc.

FIGS. 6 and 7 show a disc waferizing apparatus that employs the knife clamping arrangement of the present invention. FIG. 6 is a partial cross-section through a rotatable disc 52 having spaced, radially extending openings 56. Each opening has an associated holding location in the form of a knife carrier 58 to support a knife 60. Disc 52 is mounted on a rotatable shaft 62 carried by bearings 64.

FIG. 7 is a detail view of a holding location. Knife carrier 58 is mounted to the rotatable disc 52. There is a clamping member 65 having an inclined surface 66 to abut knife 60. Knife 60 is mounted on a counter knife 68 located in position by bolt 70. Counter knife 68 abuts inclined surface 69 of the holding location. A threaded fastener 76 engages threaded member 78 received within recess 80 in knife carrier 58. A pin 84 is provided to prevent rotation of threaded member 78. By tightening fastener 76 into threaded member 78 clamping member 65 is forced into contact with the assembly of knife 60 and counter knife 68 to clamp the knife package to knife carrier 58. In accordance with the present invention, inclined surface 66 of clamping member 65 and/or inclined surface 69 of knife carrier 58 is formed with an undulating surface. As in previous embodiments, fasteners 76 are aligned with the valleys of the undulating surface such that when the fasteners are tightened the undulating surface are deformed to give a more consistent clamping load across the knife pack than with conventional clamping designs. Again, the arrangement of the present invention can reliably clamp the knife pack to the carrier using fewer fasteners than in conventional clamping designs while providing the same clamping force.

Although the present invention has been described in some detail by way of example for purposes of clarity and understanding, it will be apparent that certain changes and modifications may be practised within the scope of the appended claims.

I claim:

1. In an apparatus for processing wood having:

a rotatable support;

a cutter;

at least one holding location on the rotatable support to receive the cutter;

a clamp to engage and hold the cutter in position at the at least one holding location; and a surface formed on at least one of the clamp and the at least one holding location having an undulating profile engageable against the cutter, the at least one surface being shaped to deform to engage the cutter with a substantially uniform clamping load upon securing of the fastener with a pre-selected force.

2. Apparatus as claimed in claim 1 in which the surface having an undulating profile is formed on the clamp.

3. Apparatus as claimed in claim 1 in which the surface having an undulating profile is formed at the at least one holding location.

4. Apparatus as claimed in claim 1 in which the clamp and the at least one holding location are each formed with a surface having an undulating profile.

5. Apparatus as claimed in claim 4 in which each undulating surface comprises a series of peaks and valleys and the clamp and at least one holding location are positioned such that the peaks of one surface are aligned with the peaks of the other surface and the valleys of one surface are aligned with the valleys of the other surface.

6. Apparatus as claimed in claim 1 in which the undulating profile comprises a series of peaks and valleys.

7. Apparatus as claimed in claim 6 in which the fastener are secured to the holding location at locations corresponding to the valleys of the undulating profile to deform the surface into a substantially flat surface against the cutting means when the fastener are secured.

8. Apparatus as claimed in claim 7 in which the fastener comprise threaded fasteners.

9. Apparatus as claimed in claim 2 in which the undulating surface comprises a series of peaks and valleys, the fastener comprises at least one threaded fastener, and the clamp comprises a clamping member formed with at least one recess to accept the at least one threaded fastener, the at least one recess being formed in a valley of the undulating surface of the clamping member.

10. Apparatus as claimed in claim 9 in which the rotatable support comprises a pair of spaced, parallel annular rings with a plurality of spaced holding locations extending between the rings at regular intervals to define a knife blade ring.

11. Apparatus as claimed in claim 10 in which the cutter comprises an elongate cutting blade formed with a cutting surface extending along at least one longitudinal edge to define a knife.

12. Apparatus as claimed in claim 11 in which each holding location comprises a knife carrier support mounted between the spaced, parallel annular rings, and a knife carrier mounted to the knife carrier support, the knife carrier and the clamping member co-operating to receive and secure a knife.

13. Apparatus as claimed in claim 11 in which the clamping member is positioned at the outside of the knife blade ring adjacent the knife carrier and the threaded fastener extends from the outside of the knife blade ring through the clamping member to engage the knife carrier.

14. Apparatus as claimed in claim 1 in which the rotatable support comprises a disc having a plurality of holding locations extending radially on the disc surface.

15. Apparatus as claimed in claim 14 in which each holding location comprises a knife carrier mounted to the rotatable disc with spaced openings between adjacent knife carriers, and openings in the rotatable disc surface corresponding to the openings between the carriers.

* * * * *